United States Patent [19]

Rogers, Jr.

[11] Patent Number: 4,915,444

[45] Date of Patent: Apr. 10, 1990

[54] RECLINER CHAIR

[76] Inventor: Walter C. Rogers, Jr., P.O. Box 685, Denton, N.C. 27239

[21] Appl. No.: 361,309

[22] Filed: Jun. 5, 1989

[51] Int. Cl.[4] ..... A47C 1/02; A61G 15/00

[52] U.S. Cl. ..... 297/68; 297/69; 297/85

[58] Field of Search ..... 297/68, 69, 70, 83, 297/84, 85, 86, 87, 75, 76

[56] References Cited

U.S. PATENT DOCUMENTS

| | | | |
|---|---|---|---|
| 27,645 | 3/1860 | McGregor | 297/68 |
| 78,304 | 5/1868 | Martin | 297/75 |
| 1,248,931 | 12/1917 | Schuman | 297/68 |
| 3,103,381 | 9/1963 | Schliephacke | 297/84 |
| 3,550,952 | 12/1970 | Ferguson | 297/85 |
| 4,410,213 | 10/1983 | Sanson | 297/84 |
| 4,570,996 | 2/1986 | Rogers | 297/85 |
| 4,669,778 | 6/1987 | rogers | 297/85 |

*Primary Examiner*—James T. McCall

*Attorney, Agent, or Firm*—William E. Mouzavires

[57] ABSTRACT

A three-way recliner chair in which a linkage system mounts a seat and backrest assembly to a stationary armrest frame for reclining movement between a generally upright or closed position, a TV position and advanced reclining positions beyond TV position. The chair is actuated to TV and reclining positions by pushing rearwardly off the armrests and against the backrest. The seat and backrest assemblies are mounted to front and rear carrier links which, in turn, are mounted by front and rear mounting links to the armrest frame. A sequencer link is pivotally connected between the front carrier link and the armrest frame to prevent relative movement between the seat and backrest when the chair is in the upright position. However, when the chair is moved towards TV position, the sequencer link will allow relative movement between the backrest and the seat. A layer of upholstery is fixed to the seat and extends continuously and is fixed to the footrest frame which is movable to a retracted position below and rearwardly of the front end of the seat with the upholstery extending about and under the front end of the seat.

14 Claims, 4 Drawing Sheets

RECLINER CHAIR

The present invention relates to recliner chairs and more specifically to a recliner chair having a novel linkage system for movably mounting the seat and backrest assembly relative to a fixed base which, in the preferred form, is provided by the armrest frame. Included herein is the provision of such a linkage system including carrier links which mount the seat and backrest assembly relative to the base and wherein a sequencer link is provided between one of the carrier links and the base to prevent relative movement between the seat and the backrest when the chair is in the generally upright or closed position but allowing relative movement between these parts when the chair is moved towards TV position. Included herein is the provision of such a recliner chair wherein the chair is actuated to TV and reclining positions by pushing off the arms and against the backrest.

Another object of the present invention is to provide a recliner chair having a novel footrest arrangement providing a continuous leg and foot support surface between the seat and the footrest proper and which, at the same time, allows the footrest to be moved to a retracted position located below the seat and rearwardly of the front end of the seat with the upholstery extending about the front and then under the seat.

DRAWINGS

Other objects and advantages of the present invention will become apparent from the following more detailed description taken in conjunction with the drawings in which.

DETAILED DESCRIPTION

Figure 1:
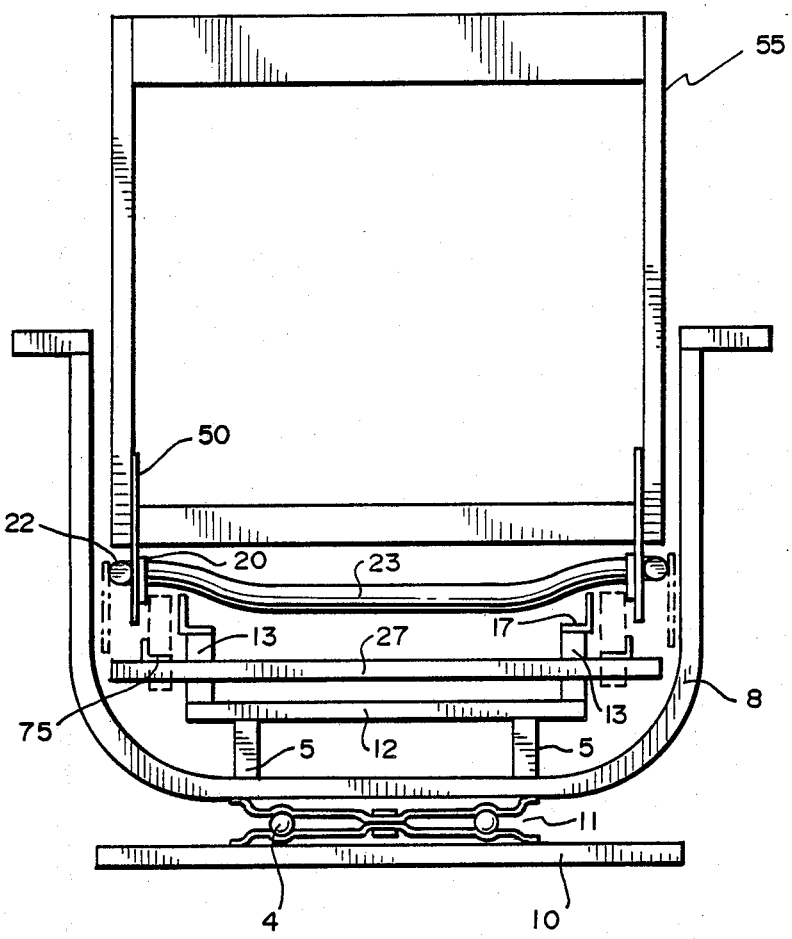
FIG. 1 is a front elevational view of a reclining chair embodying the present invention and with its upholstery removed.
Figure 2:
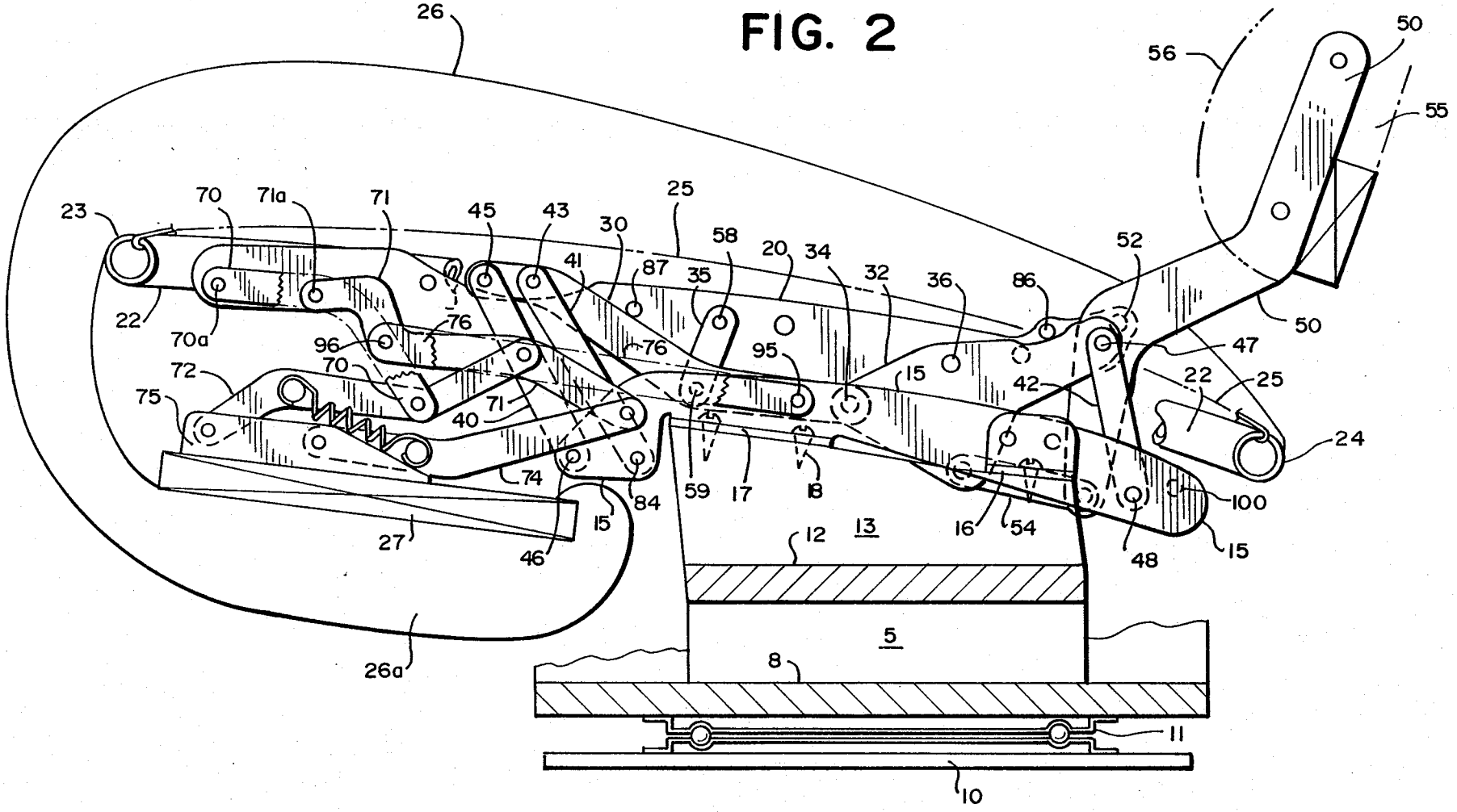
FIG. 2 is a side elevational view of the chair when in the closed or generally upright position and with portions of the backrest broken away.

Referring to FIGS. 1 and 2, a recliner chair embodying the present invention includes a base 10, an armrest frame 8 mounted on base 10 by a swivel assembly 11 including ball bearing 9. Armrest frame 8 includes a cross member or stretcher 12 extending between opposite sides thereof and fixed on blocks 5 which are fixed on the base of the armrest frame. Fixed on the stretcher 12 are a pair of laterally spaced mounting blocks 13 for mounting a base link 15 by means of flanges 16 and 17 and screws 18 as shown in FIG. 2.

Base link 15 extends in the forward-rearward direction of the chair and supports front and rear carrier links 30, 32 by means of mounting links 40 and 42 each pivotally interconnected at its opposite ends to a carrier link and base link such that the carrier links are swingable relative to the fixed base link. In this regard, link 40 is pivoted at 45 and 46 to carrier and base links 30 and 15 while link 42 is pivoted at 47 and 48 to carrier and base links 32 and 15. Carrier links 30, 32 are also pivotally connected to each other at pivot 34.

Carrier links 30, 32 support the seat of the chair which seat includes a seat link 20 extending in the forward-rearward direction of the chair where it is fixed to the seat frame including side tubes 22 and front and rear cross tubes 23, 24 made of structural steel in the specific embodiment shown. The seat link is mounted to the front carrier link 30 by means of a link 35 pivotally connected therebetween at pivots 58 and 59. Seat link 20 is pivotally mounted by pivot 36 directly to the rear carrier link 32.

The seat of the chair includes, in the shown embodiment, a sinuous wire layer 25 extending between the seat frame and a layer of upholstery 26 which may include a foam cushion layer and other conventional upholstery materials. However, in accordance with one of the features of the invention, the upholstery layer is attached to the seat frame and extends continuously from the seat to the footrest frame 26 (which in the art is at times referred to as "ottoman board") to which it is attached and which extends below the front of the seat in a generally horizontal plane such that the upholstery 26a at the front of the seat wraps or curls around and under the front of the seat as shown in FIG. 2. Moreover, the linkage is arranged such that when the footrest is extended, the upholstery layer will extend continuously without sagging between the seat and footrest to provide a continuous contoured leg support surface.

Figure 3:
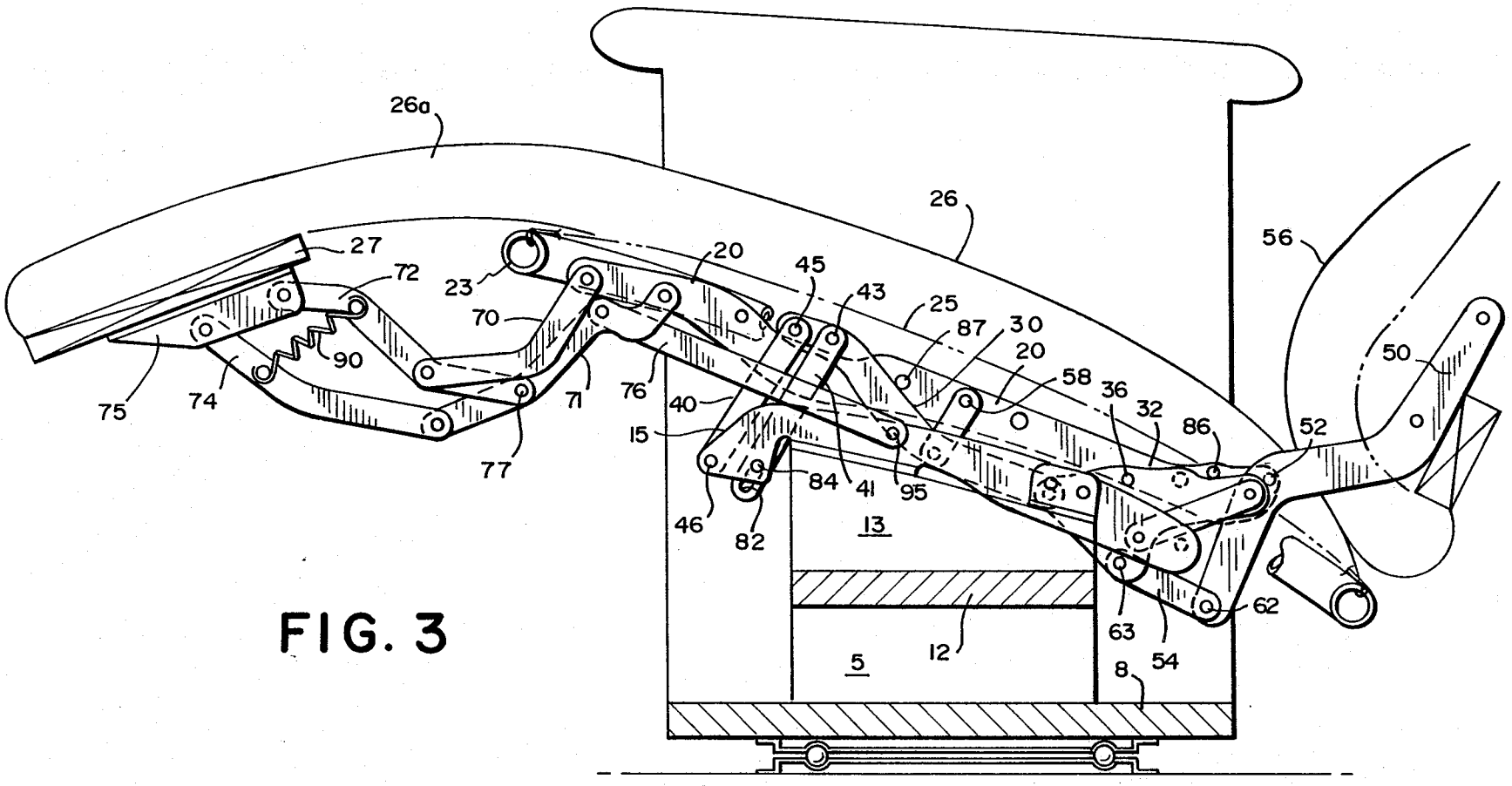
FIG. 3 is a view generally similar to FIG. 2 but with the chair shown in the TV position.

The backrest of the chair is, of course, positioned at the rear of the seat and includes a backrest link 50 fixed to the backrest frame 55 and pivoted at 52 to the rear end portion of seat link 20. Backrest frame 55 is covered by suitable upholstery 56. As shown in FIG. 3, the lower end of backrest link 50 is pivotally connected at 62 to the rear of a thrust link 54 having its forward end pivotally connected at 63 to the rear carrier link 32 at a lower portion thereof below pivot 36. Thrust link 54 functions to pivot the rear carrier link 32 when the chair is moved to advanced reclining position by exerting pressure against the backrest to pivot backrest link 50 rearwardly about pivot 52 which drives thrust link 54 forwardly to pivot carrier link 32 clockwise (as shown in FIG. 2) and which causes the seat to be moved upwardly and rearwardly relative to the base link.

The above movement is achieved after the chair is in TV position shown in FIG. 3. However, when the chair is in the closed position shown in FIG. 2, movement of the backrest relative to the seat is prevented by a sequencer link 41 in accordance with another aspect of the present invention. Sequencer link 41 has its upper end pivotally connected at 43 to a forward portion of front carrier link 30 and in its lower portion a slide 82 receives a pin 84 fixed to the base link 15. When the linkage system is in the closed position shown in FIG. 2, pin 84 will engage in the bottom of slide 82 to prevent movement of the front carrier link 32 and seat link 20 which, of course, will prevent movement between the seat and backrest. However, when the chair moves towards TV position, pin 84 will become spaced (see FIG. 3) from the bottom of slide 82 to allow the advanced reclining movement described above. Note from FIG. 4 that in the fully reclined position, pin 84 engages in the bottom of slot 82.

Figure 4:
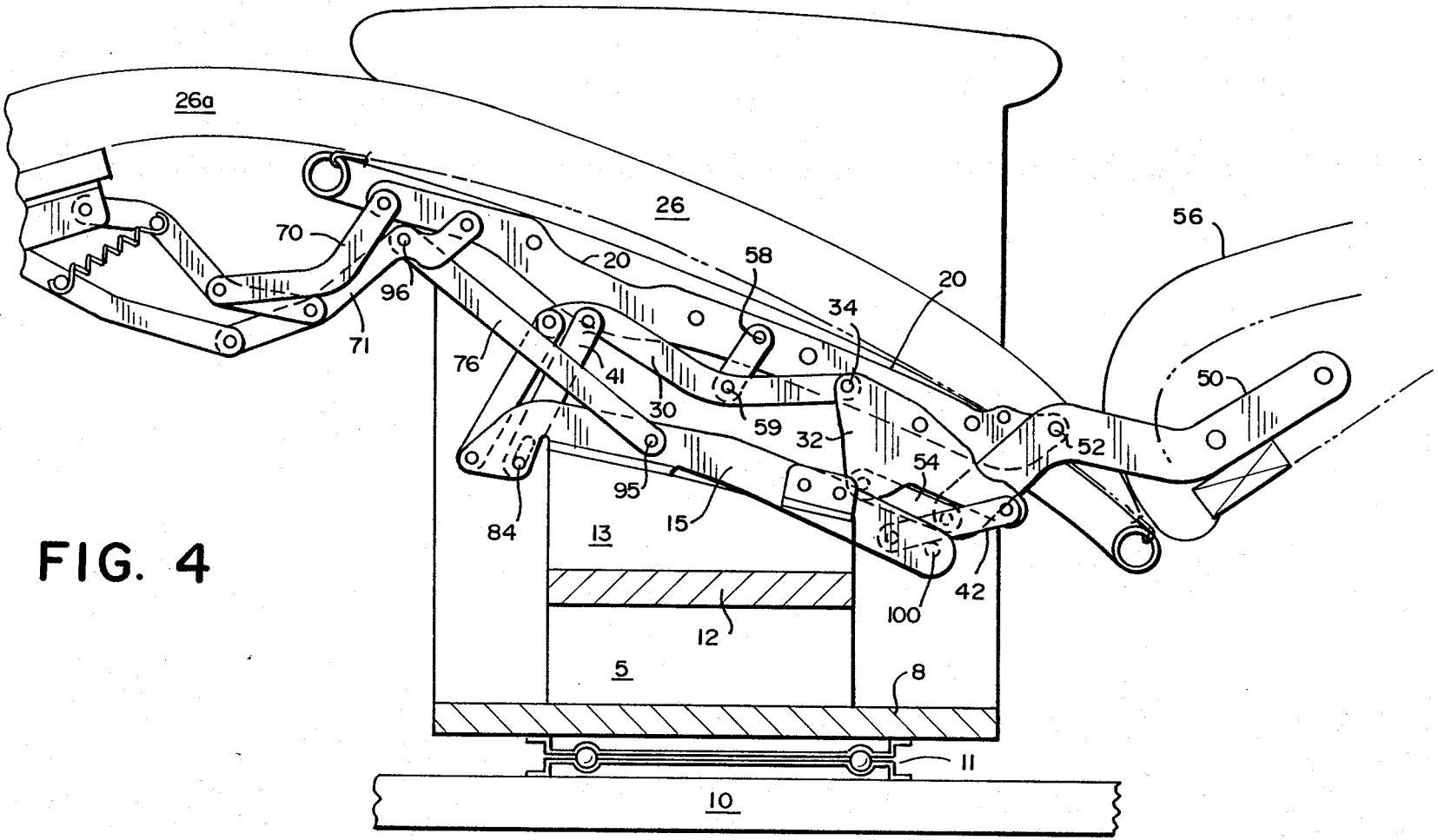
FIG. 4 is a view generally similar to FIG. 3 but with the chair shown in the fully advanced reclining position.

The footrest linkage in the shown embodiment includes a pair of mounting links 70 and 71 having their upper ends pivotally mounted to the seat link 20 at spaced locations at the front of the seat as shown at pivots **70*a* and 71*a*. Links 70 and 71 are pivotally connected to a pair of links 72 and 74 which, in turn, are connected to an ottoman link 75 which is fixed to an ottoman frame shown as a board 27. Link 71 is also pivotally connected at 77 to link 72. The footrest linkage is arranged with respect to the seat such that the ottoman link 71 and board 27, when closed or retracted, will be positioned generally horizontally below the seat and rearwardly of the front of the seat as shown in FIG. 2. The footrest is biased in closed position by a coil spring 90. Also, when the footrest is extended such as shown in FIGS. 3 or 4**, the seat and footrest upholstery extends continuously in one layer without interruption or separation at the juncture of the seat and footrest mechanism. This not only provides a highly attractive appearance, it also enhances user comfort by allowing the contour of the seat and footrest upholstery to match the contour of the user.

Actuation of the footrest and chair between the closed position shown in FIG. 2 to the open or TV position shown in FIG. 3 is achieved by the occupant grasping the armrests and pushing rearwardly with the back against the backrest. This will cause the seat 20 to move rearwardly relative to the base link 15 while also swinging upwardly at the front and downwardly at the rear to change pitch as shown in FIG. 3. A footrest control link 76 is pivoted at its rear at 95 to the base link 15 and at its front at 96 to footrest mounting link 71. Upon movement of the seat relative to the base rearwardly when moving in the TV position, control link 76 allows the footrest link 71 to pivot towards open position by the action of the seat link 20 thereon. Opening of link 71 causes the entire footrest linkage to move to extended or TV position shown in FIG. 3. In order to retract the footrest to closed position, pressure is applied with the legs on the footrest in conventional manner.

In order to move the chair to an advance reclining position beyond TV position towards full recline position of FIG. 4, the occupant exerts pressure against the backrest and the thrust link 54 pivots the rear carrier link 32 clockwise as shown in FIG. 3 which causes the front carrier link 30 to pivot counterclockwise about pivot 34. The result is that the pitch and elevation of the seat relative to the base is increased in the full recline position shown in FIG. 4. Such action not only places an occupant in a comfortable position but it also establishes a balance in the linkage enabling the reclining position to be maintained by the balance of the linkage under the occupant's weight. A stop 100 is fixed to base link 15 to engage mounting link 42 to determine the full recline position shown in FIG. 4. To return the chair to TV position of FIG. 3 from an advance reclining position, the occupant merely removes pressure from the backrest whereupon the redistribution of the occupant's weight will return the linkage to the TV position shown in FIG. 3. The position of the carrier links 30, 32 when the mechanism is in the closed or TV position, is determined by stops 86 and 87 fixed to the seat link 20 and engageable with the carrier links 30, 32 as shown in FIGS. 2 and 3.

What is claimed is:

1. A recliner chair comprising in combination a base, a seat and backrest assembly, a linkage system mounting the seat and backrest assembly on the base, a footrest linkage mounted at the front of the chair for movement between retracted and extended positions, a footrest frame connected to the footrest linkage to move between a retracted position extending generally horizontally below the seat and inwardly of the front end of the seat and an extended position projecting forwardly from the front end of the seat, layer of upholstery overlying and fixed to the seat and extending continuously to the footrest frame while being fixed thereto, said upholstery layer extending continuously from the seat to the footrest frame when the footrest is in extended position to provide a continuous leg and foot support surface, and extending convexly about the front end of the seat and below the seat when the footrest frame in in retracted position and wherein the footrest linkage is located between the footrest frame and the seat when the footrest frame and the footrest linkage are in said retracted positions.

2. The recliner chair defined in claim 1 wherein the linkage system includes a seat link fixed to the seat, front and rear carrier links pivotally connected to each other, a link pivotally interconnecting the front carrier link and the seat link to mount the seat link to the front carrier link, said seat link also being pivotally mounted to the rear carrier link, a pair of mounting links pivotally mounting the carrier links to the base, and a sequencer link pivotally connected to the front carrier link while having an elongated slot therein receiving a stop pin fixed to the base, said stop pin being engaged in a bottom portion of the slot of the sequencer link when the chair is in a generally closed or upright position to prevent relative movement between a seat and backrest included in the backrest assembly, and wherein the stop is spaced from the bottom portion of the slot when the footrest linkage is in extended position to allow the backrest to be moved relative to the seat into advanced reclining position when the footrest linkage is in extended position, and wherein the sequencer link moves relative to the stop when the backrest moves into advanced reclining position.

3. The chair defined in claim 2 which includes a pair of armrests on opposite sides of the chair and being interconnected below the chair to provide an armrest frame and wherein the linkage system is mounted to the armrest frame, and wherein the chair is actuated to TV position by an occupant pushing off the armrests and against the backrest.

4. A recliner chair movable between upright and TV positions comprising in combination a base, a seat located above the base, and a backrest, a linkage system for mounting the backrest and seat relative to the base comprising front and rear carrier links pivotally connected to each other and both being pivotally mounted to the seat, front and rear mounting links pivotally connected to the carrier links and mounting the carrier links relative to the base, a sequencer link pivotally connected to the front carrier link and having an elongated slot, a stop pin fixed to the base and received in the elongated slot of the sequencer link, said stop engaged in a bottom portion of the slot when the chair is in an upright position.

5. The chair defined in claim 4 including a footrest and linkage means for driving the footrest to extended position, and wherein said stop pin is spaced from the bottom portion of the seat when the footrest is moved to extended position.

6. The chair defined in claim 5 which includes a pair of armrests on opposite sides of the chair and being interconnected and supported on the base below the seat to provide an armrest frame and wherein the linkage system is mounted to the armrest frame, and wherein the chair is actuated to TV position by an occupant pushing off the armrests and against the backrest.

7. The chair defined in claim 6 wherein said linkage system further includes a backrest link fixed to the backrest and being pivotally mounted intermediate its ends to the seat, and a thrust link pivotally interconnecting a lower portion of said backrest link and said rear carrier link.

8. The chair defined in claim 4 wherein said linkage system further includes a backrest link fixed to the backrest and being pivotally mounted intermediate its ends to the seat, and a thrust link pivotally interconnecting a lower portion of said backrest link and said rear carrier link.

9. The chair defined in claim 3 wherein said linkage system further includes a backrest link fixed to the backrest and being pivotally mounted intermediate its ends to the seat, and a thrust link pivotally interconnecting a lower portion of said backrest link and said rear carrier link.

10. The chair defined in claim 2 wherein said linkage system further includes a backrest link fixed to the backrest and being pivotally mounted intermediate its ends to the seat, and a thrust link pivotally interconnecting a lower portion of said backrest link and said rear carrier link.

11. The chair defined in claim 4 further including a footrest frame, and footrest linkage means mounting the footrest frame for movement between a retracted position located under the seat in a generally horizontal plane with the footrest linkage located between the frame and the seat, and an extended position with the footrest frame projected forwardly of the seat.

12. The chair defined in claim 8 further including a footrest frame, and footrest linkage means mounting the footrest frame for movement between a retracted position located under the seat in a generally horizontal plane with the footrest linkage located between the frame and the seat, and an extended position with the footrest frame projected forwardly of the seat.

13. The chair defined in claim 3 further including a swivel between the armrest frame and the base.

14. The chair defined in claim 7 further including a swivel between the armrest frame and the base.

* * * * *